United States Patent [19]

Vickery

[11] 3,931,603

[45] Jan. 6, 1976

[54] TEMPERATURE RESPONSIVE ELECTRICAL SWITCH CONSTRUCTION AND METHOD OF MAKING THE SAME

[75] Inventor: Arthur V. Vickery, Maryville, Tenn.

[73] Assignee: Robertshaw Controls Company, Richmond, Va.

[22] Filed: Sept. 19, 1974

[21] Appl. No.: 507,340

[52] U.S. Cl. ..... 337/360; 337/380

[51] Int. Cl.[2] ..... H01H 37/12

[58] Field of Search ..... 337/360, 362, 365, 368, 337/372, 380, 94, 89, 85

[56] References Cited

UNITED STATES PATENTS

| | | | |
|---|---|---|---|
| 2,750,475 | 6/1956 | Clason | 337/380 |
| 2,751,464 | 6/1956 | Short et al. | 337/380 |
| 2,753,421 | 7/1956 | Mertler | 337/347 |
| 3,255,331 | 6/1966 | Ulanet | 337/360 |

*Primary Examiner*—Harold Broome

*Attorney, Agent, or Firm*—Candor, Candor & Tassone

[57] ABSTRACT

A temperature responsive electrical switch construction having a housing provided with a chamber therein. A pair of spaced apart contacts project into the chamber and are adapted to be bridged by a bridging member disposed in the chamber and being operatively interconnected to a bimetal member also disposed in the chamber whereby movement of the bridging member relative to the contacts is in relation to the sensed temperature of the bimetal member. The housing has a threaded adjusting arrangement for initially adjusting the contact pressure between the contacts and the bridging member when the bimetal member is sensing a certain temperature without effecting the operating temperature of the electrical switch construction.

18 Claims, 5 Drawing Figures

TEMPERATURE RESPONSIVE ELECTRICAL SWITCH CONSTRUCTION AND METHOD OF MAKING THE SAME

This invention relates to an improved temperature responsive electrical switch construction as well as to an improved method of making such a switch construction or the like.

It is well known that temperature responsive electrical switch constructions have been provided wherein each has the electrical switch thereof opened and closed by a temperature sensing bimetal member.

It is a feature of this invention to provide an improved temperature responsive electrical switch construction of the above type wherein the switch construction has means for initially adjusting the contact pressure of the switch when the bimetal member is sensing a certain temperature without effecting the operating temperature of the electrical switch construction.

In particular, one embodiment of this invention provides a temperature responsive electrical switch construction having a housing means provided with the chamber therein. A pair of spaced apart contacts are carried by the housing means and project into the chamber. A movable bridging member is disposed in the chamber for bridging the contacts when disposed against the same. A bimetal member is also disposed in the chamber and is operatively interconnected to the bridging member to control movement thereof relative to the contacts in relation to the sensed temperature of the bimetal member. The housing means had adjusting means for initially adjusting the contact pressure between the contacts and the bridging member when the bimetal member is sensing a certain temperature without effecting the operating temperature of the electrical switch construction. Such adjusting means can comprise a threaded relationship between two housing parts of the housing means respectively carrying the pair of contacts and the bridging member.

Accordingly, it is an object of this invention to provide an improved temperature responsive electrical switch construction having one or more of the novel features set forth above or hereinafter shown or described.

Another object of this invention is to provide an improved method of making a temperature responsive electrical switch construction, the method of this invention having one or more of the novel features set forth above or hereinafter shown or described.

Other objects, uses and advantages of this invention are apparent from a reading of this description which proceeds with reference to the accompanying drawings forming a part thereof and wherein.

Figure 1:
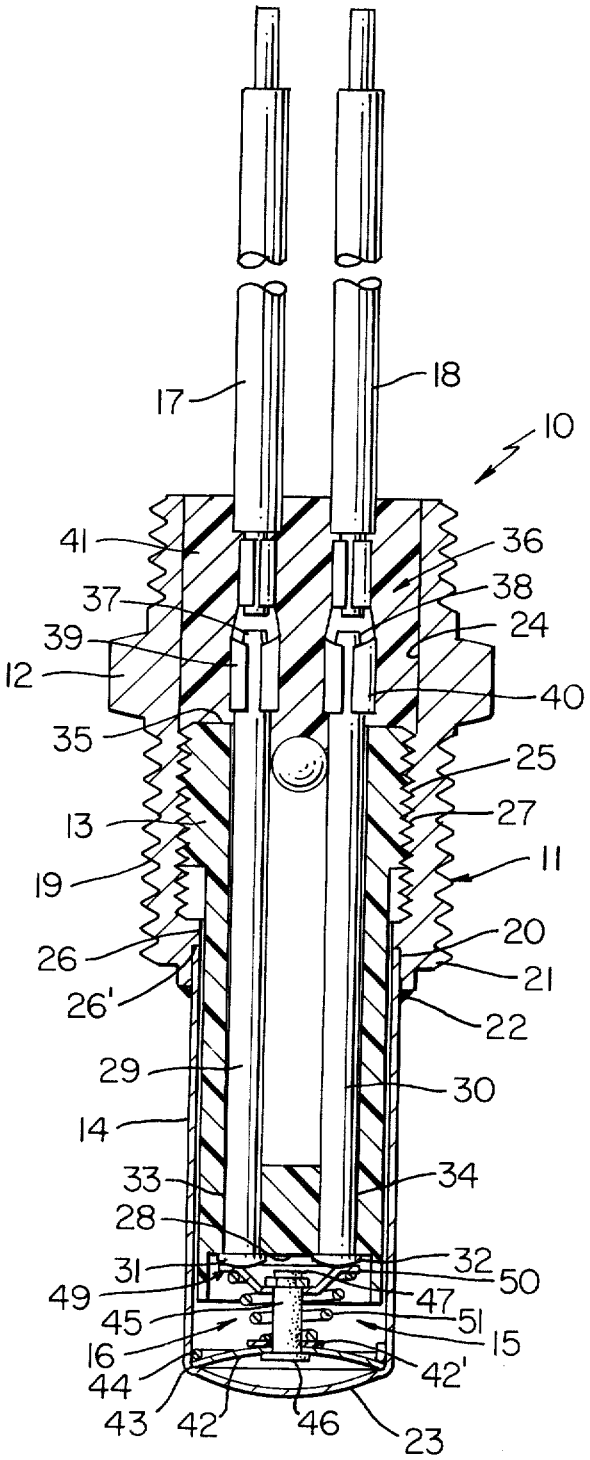
FIG. 1 is a cross-sectional view illustrating one embodiment of the temperature responsive electrical switch construction of this invention.

While the various features of this invention are hereinafter described and illustrated as being particularly adapted to provide a temperature responsive electrical switch construction for immersion in a fluid bath for sensing the temperature thereof, it is to be understood that the various features of this invention can be utilized singly or in any combination thereof to provide a temperature sensing device for other structures as desired.

Therefore, this invention is not to be limited to only the embodiment illustrated in the drawings, because the drawings are merely utilized to illustrate one of the wide variety of uses of this invention.

Figure 2:
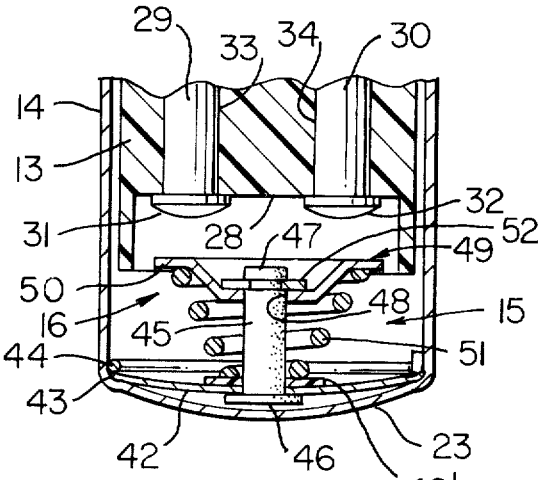
FIG. 2 is an enlarged fragmentary view of the electrical switch portion of the switch construction of FIG. 1 and illustrates the electrical switch construction in an open condition thereof.

Referring now to FIGS. 1–4, one embodiment of the temperature responsive electrical switch construction of this invention is generally indicated by the reference numeral 10 and comprises a housing means 11 formed from a plurality of housing parts 12, 13 and 14 secured together in a manner hereinafter described to define a chamber 15 in the housing means 11 that contains a temperature responsive electrical switch that is generally indicated by the reference numeral 16 and which is adapted to complete an electrical circuit between a pair of external leads 17 and 18 when the electrical switch 16 is in the closed position as illustrated in FIG. 1 or to break the electrical circuit between the leads 17 and 18 when the electrical switch 16 is in the open condition as illustrated in FIG. 2.

The housing part 12 is externally threaded at 19 to permit the electrical switch construction 10 to be threaded in a suitable opening of a container (not shown) so that at least the housing part 14 is immersed in the fluid of the container. In this manner, the housing part 14 will sense the temperature thereof, the housing part 14 being a substantially cylindrical and cup-shaped and having its open end 20 sealed and secured to the lower end 21 of the housing part 12 by selding means 22 or the like.

The cylindrical housing part 14 has a closed end 23 that is bowed outwardly as illustrated at one end of the chamber 15 whereby the housing part 14 defines a bulb-like temperature sensing part of the housing means 11 in a manner hereinafter described.

The housing part 12 has a bore or opening 24 passing therethrough with a portion 25 of the bore 24 being internally threaded while another portion 26 of the bore 24 defines an inwardly projecting annular stop shoulder 26' against which the open end 20 of the housing part 14 abuts and against which the other housing part 13 is adapted to abut as will be apparent hereinafter.

The housing part 13 is formed from electrical insulating material and has an externally threaded portion 27 adapted to be disposed in threaded relation with the threaded portion 25 of the housing part 12 as illustrated so that the axial position of a lower wall 28 of the housing part 13 can be adjusted relative to the end wall 23 of the housing part 14 for a purpose hereinafter described, the annular shoulder 26' of the housing part 12 limiting the amount of threaded insertion of the housing part 13 into the housing part 12 as the threaded portion 27 will abut the same if the housing part 13 is threaded into the housing part 12 to too great an extent.

The housing part 13 carries a pair of contact pins 29 and 30 respectively having enlarged contact ends 31 and 32 respectively abutting against the end surfaces 28 of the housing part 13 while the shank portions of the pins 29 and 30 respectively pass through openings 33 and 34 formed in the housing part 13 to project out of the other end wall 35 of the housing part 13 into a chamber 36 disposed in the outer part of the opening 24 of the housing part 12 as illustrated.

The leads 17 and 18 are adapted to be respectively interconnected to the outer projecting pin ends 37 and 38 of the contact pins 29 and 30 by slip-on lead connectors 39 and 40 of the leads 17 and 18 in a manner well known in the art so that the leads 17 and 18 are respectively interconnected to the enlarged contact heads 31 and 32 that are disposed in the chamber 15 of the housing means 11.

The chamber 36 is subsequently filled with an electrical insulating material, such as a resin material that is indicated by the reference numeral 41 in FIG. 1, to not only electrically seal the interconnection between the leads 17 and 18 and the contact pins 29 and 30 as illustrated, but also to secure the housing parts 12 and 13 in the desired threaded relationship therebetween for a purpose hereinafter described.

A bimetal snap disc 42 is disposed in the chamber 15 with its outer peripheral edge 43 disposed adjacent the juncture of the end wall 23 of the housing part 14 with the remainder of the housing part 14, the bimetal disc 42 being held in place by an annular spring member 44 also disposed in the chamber 15 and engaging the outer peripheral edge 43 of the bimetal disc 42.

An insulating post 45 has one end 46 fixed to the central portion of the bimetal disc 42 and has its other end 47 projecting loosely through an opening 43 formed in an electrically conductive bridging member 49 that has an outer annular flange 50 for contacting against the enlarged contact heads 31 and 32 to bridge the same when the bimetal member 42 is disposed in the snapped position illustrated in FIG. 1 when the bimetal member 42 is sensing at least a certain operating temperature thereof.

A compression spring 51 is disposed between an insulating washer 42′ on the bimetal member 42 and the bridging member 49 to tend to urge the same against a retaining ring 52 that defines an enlarged end of the post 45 so that bridging member 49 would normally be spaced from the bimetal member 42 by the spring 51 a certain distance limited by the enlarged end or retaining ring 52 of the post 45 while the loose connection between the post 45 and the bridging member 49 permits an overrun condition as will be apparent hereinafter.

Since the bridging member 49 is loosely disposed on the end 47 of the post 45 while being urged toward the enlarged end or retaining ring 52 thereof by the compression spring 51, the contact pressure of the bridging member 49 against the contact heads 31 and 32 can be initially adjusted during the assembly of the temperature responsive electrical switch construction 10 of this invention.

In particular, the housing part 13 can be threaded into the threaded portion 25 of the housing part 12 when the bimetal member 42 is sensing a certain temperature that causes the same to be in the bowed condition illustrated in FIG. 1 and tending to close the electrical switch 16. Thus, the housing part 13 is threaded into the housing part 12 until the desired contact pressure of the spring 51 forcing the bridging member 49 against the contacts 31 and 32 is obtained as the bridging member 49 slides on the post 45 toward the bimetal member 42 in opposition to the force of the compression spring 51 during such threading together of the housing parts 12 and 13. Once the desired threaded relationship between the housing parts 12 and 13 is obtained, the threaded relationship is secured by the resin material 41 subsequently being disposed in the chamber 36 which not only electrically seals the leads 17 and 18 to the contact pins 29 and 30, but also secures the housing parts 12 and 13 in the set threaded relationship therebetween for maintaining the desired contact pressure of the bridging member 49 against the contacts 31 and 32 during all subsequent operation of the electrical switch construction 10.

This initial adjustment of the contact pressure of the bridging member 49 with the contacts 31 and 32 does not effect the operating temperature of the bimetal member 42 as the operation of the bimetal member 42 is independent of the adjustment between the housing parts 12 and 13. Thus, the operating temperature of the temperature responsive electrical switch construction 10 of this invention is determined by the actual operating condition of the bimetal member 42 itself as will be apparent hereinafter.

Thus, it can be seen that the temperature responsive electrical switch construction 10 of this invention can be formed of a relatively few parts and permit an adjustment of the switch contact pressure thereof for maintaining good electrical contact between the leads 17 and 18 whenever the switch 16 is in its closed condition.

The operation of the temperature responsive electrical switch construction 10 of this invention will now be described.

Assuming that the bimetal member 42 is to open the switch 16 of the temperature responsive electrical switch construction 10 when the bulb portion 14 of the housing means 11 is sensing a certain temperature or below and is to close the switch 16 when the bulb portion 14 is sensing the certain temperature or slightly above the certain temperature, the bimetal member 42 will be sensing substantially the same temperature as the bulb portion 14 of the housing means 11 when the housing means 11 is immersed in a fluid being monitored by the electrical switch construction 10.

Figure 3:
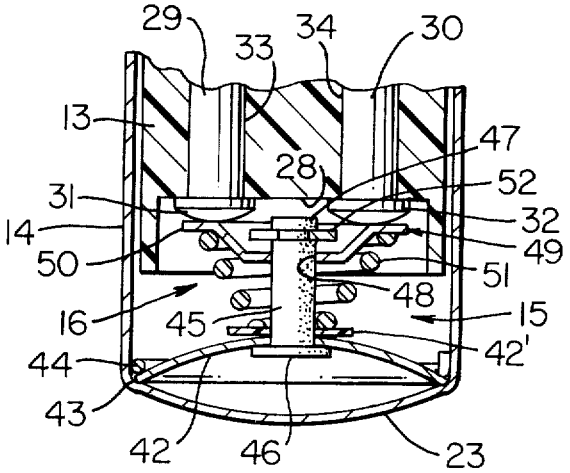
FIG. 3 is a view similar to FIG. 2 and illustrates the switch construction in a closed condition thereof as well as in an overrun condition thereof.
Figure 4:
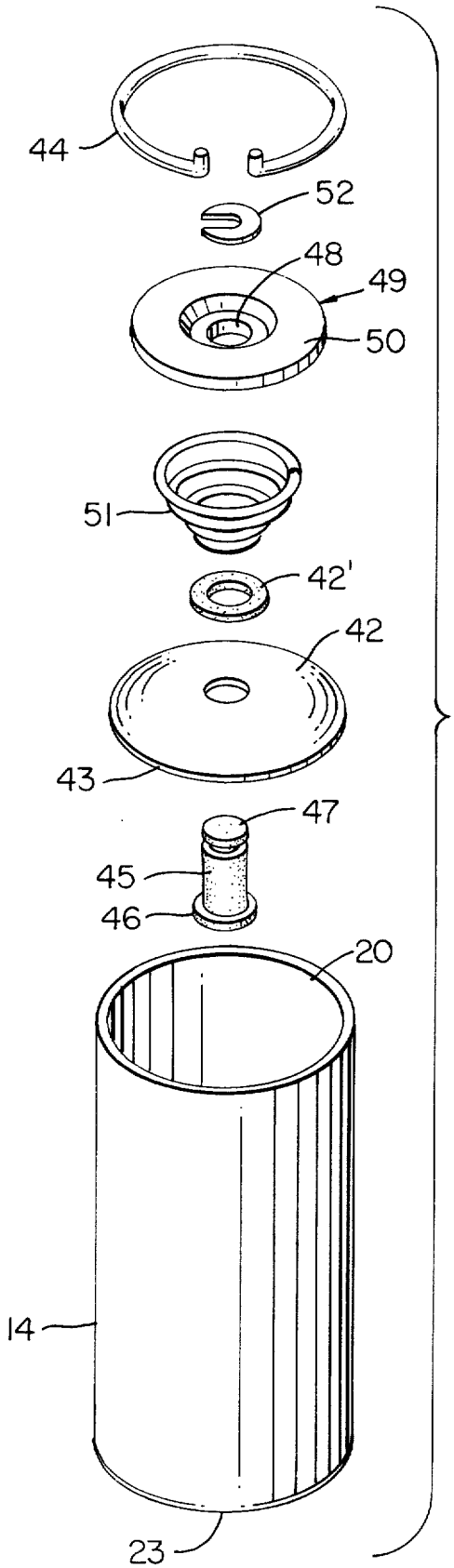
FIG. 4 is an exploded perspective view of certain parts of the electrical switch construction of FIG. 1.

Thus, as long as the temperature of the fluid being sensed by the bulb 14 is at the certain temperature or below, the bowed condition of the snap disc 42 is as illustrated in FIGS. 1 and 3 whereby the bridging member 49 maintains electrical contact between the contacts 31 and 32 and, thus, between the leads 17 and 18 and even though the bimetal member 42 is bowing a greater amount as illustrated in FIG. 3 over the amount illustrated in FIG. 1′because of sensing a lower temperature in FIG. 3, the overrun condition between the post 45 and the opening 48 of the bridging member 49 permits this excessive bowing condition of the bimetal member 42 without damage to the bimetal member 42.

However, when the temperature of the fluid being monitored by the temperature responsive electrical switch construction 10 reaches the certain operating temperature of the bimetal member 42, the bimetal member 42 snaps from the position illustrated in FIG. 1 to the position illustrated in FIG. 2 and the post 45 carries the bridging member 49 out of contact with the contacts 31 and 32 to thereby open the switch 16 and terminate the interconnection between the leads 17 and 18 until the temperature of the bimetal member 42 again falls to the certain temperature or slightly below the same at which time the bimetal member 42 snaps back to the condition illustrated in FIG. 1 to again close the bridging member 49 against the contacts 31 and 32.

Thus, it can be seen that the temperature responsive electrical switch contruction 10 is adapted to have the switch 16 opened and closed in relation to the sensed temperature of the bimetal member 42 so that the bimetal member 42 will cause the switch 16 to close at a certain temperature and to open at a certain temperature regardless of the previously adjusted contact pressure that exists between the bridging member 49 and the contacts 31 and 32 when the switch 16 is in a closed condition thereof.

Figure 5:
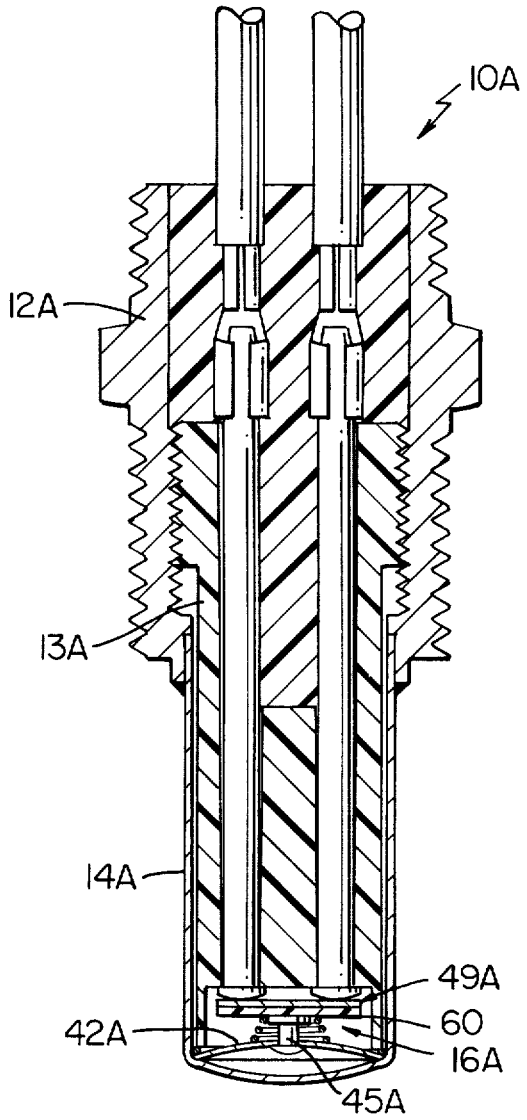
FIG. 5 is a view similar to FIG. 1 and illustrates another embodiment of this invention.

Another temperature responsive switch construction of this invention is generally indicated by the reference numeral 10A in FIG. 5 and parts thereof similar to the temperature responsive electrical switch construction 10 prefiously described are indicated by like reference numerals followed by the reference letter "A".

The temperature responsive electrical switch construction 10A is substantially identical to the switch construction 10 previously described except that the post 45A is formed of conductive material and is separated from the bridging member 49A by an interposed insulating member 60 whereby the insulating member 60 insulates the bridging member 49A from the post 45A, bimetal member 42A and housing part 14A whereas the electrical switch construction 10A operates in the same manner as the switch construction 10 previously described.

Of course, the bimetal members 42 and 42A for the constructions 10 and 10A could be chosen to close the switches 16 and 16A upon falling temperature rather than on rising temperature as previously described.

Therefore, it can be seen that this invention not only provides an improved temperature responsive electrical switch construction, but also this invention provides an improved method of making such an electrical switch construction or the like.

While the forms and methods of this invention now preferred have been described and illustrated as required by the Patent Statute, it is to be understood that other forms and method steps can be utilized and still come within the scope of the appended claims.

What is claimed is:

1. A temperature responsive electrical switch construction comprising a housing means having a chamber therein, a pair of spaced apart contacts carried by said housing means and projecting into said chamber, a movable bridging member disposed in said chamber for bridging said contacts when disposed against the same, a bimetal member disposed in said chamber and being operatively interconnected to said bridging member to control movement thereof relative to said contacts in relation to the sensed temperature of said bimetal member, said housing means having adjusting means for initially adjusting the contact pressure between said contacts and said bridging member when said bimetal member is sensing a certain temperature, and interconnection means interconnecting said bimetal member to said bridging member, said interconnection means having overrun means to prevent excessive load on said bimetal member during adjustment of said contact pressure, said interconnection means comprising a post carried by said bimetal member and projecting loosely through said bridging member to provide lost motion therebetween in a contact closing direction.

2. A temperature responsive electrical switch construction as set forth in claim 1 wherein said housing means has a sealed bulb-like portion, said chamber being in said bulb-like portion of said housing means.

3. A temperature responsive electrical switch construction as set forth in claim 2 wherein said bimetal member comprises a bimetal snap member disposed in the end of said bulb-like portion.

4. A temperature responsive electrical switch construction as set forth in claim 3 wherein said bulb-like portion is substantially cylindrical, said bimetal snap member being a substantially circular disc disposed in said end of said cylindrical bulb-like portion of said housing means.

5. A temperature responsive electrical switch construction as set forth in claim 1 wherein said adjusting means of said housing means comprises a first housing part that carries said bimetal member and said bridging member threaded to a second housing part that carries said contacts.

6. A temperature responsive electrical switch construction as set forth in claim 5 wherein locking means locks said threaded parts of said housing means in the desired adjusted position thereof.

7. A temperature responsive electrical switch construction as set forth in claim 6 wherein said locking means comprises a sealing compound.

8. A temperature responsive electrical switch construction as set forth in claim 1 and including a compression spring disposed between said bridging member and said bimetal member to tend to urge said bridging member away from said bimetal member.

9. A temperature responsive electrical switch construction as set forth in claim 8 wherein said compression spring is a coiled compression spring disposed about said post.

10. A method of making a temperature responsive electrical switch construction comprising the steps of forming a housing means with a chamber therein, disposing a pair of spaced apart contacts in said housing means to project into said chamber, disposing a movable bridging member in said chamber for bridging said contacts when disposed against the same, disposing a bimetal member in said chamber to be operatively interconnected to said bridging member to control movement thereof relative to said contacts in relation to the sensed temperature of said bimetal member, forming said housing means with adjusting means for initially adjusting the contact pressure between said contacts and said bridging member when said bimetal member is sensing a certain temperature, interconnecting said bimetal member to said bridging member with interconnection means that has overrun means to prevent excessive load on said bimetal member during adjustment of said contact pressure, and forming said interconnection means from a post carried by said bimetal member and projecting loosely through said bridging member to provide lost motion therebetween in a contact closing direction.

11. A method of making a temperature responsive electrical switch construction as set forth in claim 10 and including the step of forming said housing means with a sealed bulb-like portion having said chamber therein.

12. A method of making a temperature responsive electrical switch construction as set forth in claim 11 and including the steps of forming said bimetal member as a bimetal snap member, and disposing said bimetal member in the end of said bulb-like portion.

13. A method of making a temperature responsive electrical switch construction as set forth in claim 12 and including the steps of forming said bulb-like portion substantially cylindrical, and forming said bimetal snap member as a substantially circular disc disposed in said end of said cylindrical bulb-like portion of said housing means.

14. A method of making a temperature responsive electrical switch construction as set forth in claim 10 wherein said step of forming said adjusting means of said housing means comprises the steps of forming a first housing part that carries said bimetal member and said briding member, and threading said first housing part to a second housing part that carries said contacts.

15. A method of making a temperature responsive electrical switch construction as set forth in claim 14 and including the step of locking said threaded parts of said housing means in the desired adjusted position thereof with locking means.

16. A method of making a temperature responsive electrical switch construction as set forth in claim 15 and including the step of forming said locking means from a sealing compound.

17. A method of making a temperature responsive electrical switch construction as set forth in claim 10 and including the step of disposing a compression spring between said bridging member and said bimetal member to tend to urge said bridging member away from said bimetal member.

18. A method of making a temperature responsive electrical switch construction as set forth in claim 17 and including the steps of forming said compression spring as a coiled compression spring, and disposing said coiled compression spring about said post.

* * * * *